US007003866B2

(12) United States Patent
Mäkitalo et al.

(10) Patent No.: US 7,003,866 B2
(45) Date of Patent: Feb. 28, 2006

(54) METHOD IN A SHEET METAL WORKING CENTRE AND SHEET METAL WORKING CENTRE

(75) Inventors: Juha Mäkitalo, Pinsiö (FI); Kari Liinamaa, Ylihärmä (FI)

(73) Assignee: Lillbacka Jetair OY, Kauhava (FI)

( * ) Notice: Subject to any disclaimer, the term of this patent is extended or adjusted under 35 U.S.C. 154(b) by 66 days.

(21) Appl. No.: 10/415,833

(22) PCT Filed: Dec. 3, 2001

(86) PCT No.: PCT/FI01/01048

§ 371 (c)(1),
(2), (4) Date: May 2, 2003

(87) PCT Pub. No.: WO02/45880

PCT Pub. Date: Jun. 13, 2002

(65) Prior Publication Data

US 2004/0074277 A1 Apr. 22, 2004

(51) Int. Cl.
*B23P 23/00* (2006.01)

(52) U.S. Cl. ..... 29/563; 29/33 P

(58) Field of Classification Search ..... 29/563, 29/564, 33 P, 564.1, 564.2, 564.7, 33 Q; 700/165, 167, 186

See application file for complete search history.

(56) References Cited

U.S. PATENT DOCUMENTS

| | | | | |
|---|---|---|---|---|
| 4,583,719 | A | 4/1986 | Klingel | |
| 4,658,682 | A | 4/1987 | Taijonlahti et al. | |
| 4,682,401 | A * | 7/1987 | Tadashi et al. | 29/563 |
| 5,187,958 | A | 2/1993 | Prunoto et al. | |
| 5,407,415 | A * | 4/1995 | Spishak | 29/563 |
| 5,933,933 | A * | 8/1999 | Fritz et al. | 29/33 P |

FOREIGN PATENT DOCUMENTS

| | | |
|---|---|---|
| EP | 0 102 646 | 3/1984 |

* cited by examiner

*Primary Examiner*—Erica Cadugan
(74) *Attorney, Agent, or Firm*—Louis Woo

(57) ABSTRACT

A method in a sheet metal working center, wherein a sheet secured to mounting member of a moving carriage arrangement is transferred in accordance with a predetermined program substantially in XY orthogonal coordinates in the main plane of the sheet so that machining of the sheet may be carried out by multiple machining units. At least two of the machining units are placed in the sheet metal working center and have separate XY orthogonal coordinates, and directions X of the separate XY orthogonal coordinates of the machines are combined to a common direction X of the sheet metal working center.

12 Claims, 1 Drawing Sheet

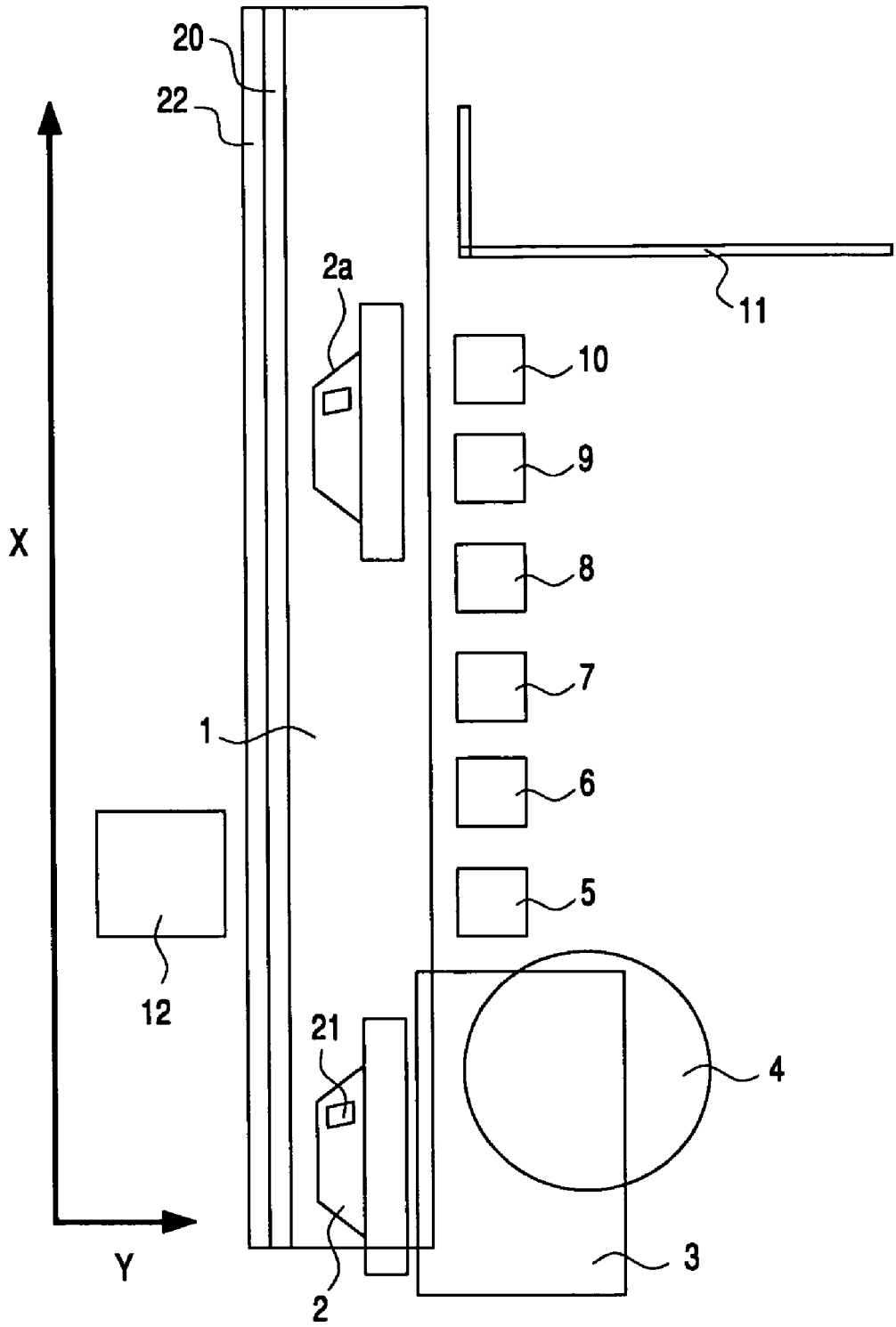
Figure

METHOD IN A SHEET METAL WORKING CENTRE AND SHEET METAL WORKING CENTRE

FIELD OF THE INVENTION

The invention relates to a method in a sheet metal working centre, wherein a sheet secured to mounting means of a moving carriage arrangement in connection with said sheet metal working centre is transferred in accordance with a predetermined program substantially in the orthogonal coordinates X, Y in the main plane of the sheet in order to carry out machinings or the like directed to the sheet.

BACKGROUND OF THE INVENTION

The present invention relates to such sheet metal working centres in which sheets are handled to machine them to a desired form. As a general rule, the objects to be machined are metal sheets, e.g. 1250×2500 mm or 1500×3000 mm in size. Typically, the thickness of the metal sheets is variable between 0.5 mm and 3.5 mm, wherein reference is generally made to so-called thin sheets, or thin sheet metal working centres, respectively. Typical machinings performed for sheets in a sheet metal working centre include e.g. punching, angular cutting, thread cuffing or riveting. Other operations that can be directed to a sheet include e.g. providing the surface of an otherwise completed sheet with various markings using an adhesive-label machine (EAN coding), or the like.

As to the prior art, reference is made to a U.S. Pat. No. 4,658,682, describing one automatic sheet metal working machine. A sheet metal working machine typically comprises a frame and a carriage arrangement moving relative to the frame and comprising a first carriage and a second carriage that is mounted in the first carriage and moving in a direction perpendicular relative to the direction of motion of said first carriage. Said second carriage comprises mounting means, e.g. a set of mounting jaws, to secure the edge portion of the sheet that is to be machined to the carriage arrangement. The first and the second carriage of the carriage arrangement can be used for moving the sheet to be machined substantially in the coordinates X, Y of the main plane of the sheet relative to the machining unit used, e.g. a punch or a cutter.

Modern machining units intended for sheet metal work are controlled by numerical computer control. In the memory of a control centre situated in connection with the sheet metal working centre, there is stored a machining program, which a machining unit runs automatically under control of the control centre. Programs and devices related to automatic control of machining units intended for sheet metal working as well as functions related thereto, are well known in the field as such, and therefore these will not be described in more detail in this context.

Even though the sheet metal working machine disclosed in U.S. Pat. No. 4,658,682 is advantageous as such, modern demands on sheet metal production have come up with problems in this kind of sheet metal production, in which various machining units are used for machining a sheet to be machined one machining phase at a time. The purpose of the present invention is to disclose an improved method in sheet metal machining, in which a plurality of various machinings or the like are directed to a sheet. By using the basic solution of the invention it is possible to attain a versatile sheet metal working centre that implements a total range of certain machining phases in a single complex. Adapting the basic solution of the invention, a variety of sheet metal working centre complexes are provided, that have a customized number of machining units or the like.

SUMMARY OF THE INVENTION

To attain the above-described purposes, the method according to the invention is primarily characterized in that at least two machining units or the like that perform different machinings or the like, are placed in the sheet metal working centre, and that the directions X of the orthogonal X, Y coordinates of the separate machining units or the like are combined to constitute a common direction X comprising the entire sheet metal working centre, and that the carriage arrangement and the sheet secured to the mounting means thereof, are transferred according to a program predetermined for the machining treatment of the sheet in question between machinings or the like and, if necessary, during machinings or the like performed by different machining units or the like in the common direction X.

The sheet metal working centre according to the invention, in turn, is primarily characterized in that the sheet metal working centre comprises at least two machining units or the like that perform different machinings or the like, and that the directions X of the orthogonal X, Y coordinates of separate working units or the like, are combined to constitute a common direction X comprising the entire sheet metal working centre, and that the carriage arrangement and the sheet secured to the mounting means thereof are arranged to be transferred according to a program predetermined for the machining treatment of the sheet in question between machinings or the like and, if necessary, during machinings or the like performed by different machining units or the like at least in said common direction X.

Other dependent claims related both to the method and the sheet metal working centre present some preferred embodiments of the method and the sheet metal working centre according to the invention.

DESCRIPTION OF THE FIGURE

The invention will be illustrated in more detail in the description hereinbelow, in which reference is made to a schematic FIGURE illustrating a top view of a sheet metal working centre applying the method of the invention.

DETAILED DESCRIPTION OF THE INVENTION

The sheet metal working centre illustrated schematically in the FIGURE comprises an elongated auxiliary frame 1, in which a carriage arrangement 2, which is provided with mounting means (not shown), is mounted. A second carriage arrangement 2*a* may also be movably mounted to auxiliary frame 1. The sheet 3 to be machined, mounted in the mounting means of the carriage arrangement 2, is arranged to be transferred in accordance with a predetermined program, substantially in the orthogonal coordinates X,Y in the main plane of the sheet 3 in order carry out machining or other corresponding measures directed to the sheet 3 by using machining units or units 4 to 11, these units being separate and positioned proximate relative to the auxiliary frame 1. A control unit 12 is operatively connected to the sheet metal working centre, and thus to the plurality of machining units 4 to 11. Control unit 12, among other things, identifies the machining units and controls the respective functions thereof The aforenoted predetermined program may be stored in the memory of the control unit 12. Thus, the sheet metal working centre applying the invention comprises a plurality of machining units, or the like, at least two of which may be carrying out at least two different machinings, or the like.

The direction X of the orthogonal coordinates X, Y of each separate machining unit or the like 4 to 11 is combined with the direction X that is common to the entire sheet metal working centre and is, as already mentioned, located in the longitudinal direction of the auxiliary frame 1. The carriage arrangement 2 and the sheet 3 attached on the mounting means thereof are arranged to be transferred according to a program predetermined for the machining treatment of said sheet 3, between machinings or the like carried out by at least some machining units or the like 4 to 11. During or between machinings or the like, carried out by a certain machining unit or the like, the sheet 3 moves, by means of movements implemented by the carriage arrangement 2 in individual coordinates X, Y of the machining unit or the like in question, wherein the movements in the direction X take place in said direction X that is common to the entire sheet metal working centre.

In control centre 12 in connection with the sheet metal working centre there is arranged a control algorithm by means of which an origin point 1. (x=0, y=0) located in the individual coordinates X, Y of each separate machining unit or the like 4 to 11, in a common direction X that is longitudinally parallel with the auxiliary frame 1, is arranged to be identified. The auxiliary frame 1, and in a corresponding manner the carriage arrangement 2, comprises means (e.g. a combined measuring beam and carriage arrangement) for positioning of the carriage arrangement 2 in the common direction X. The auxiliary frame 1 can be advantageously provided with a measuring beam 20 or the like that shares the same length with the auxiliary frame 1, and the carriage arrangement 2 with a sensor 21. In the longitudinal auxiliary frame 1 and the carriage arrangement 2 there is placed a linear servo motor arrangement (schematically shown at 22) that substantially shares the same length with the auxiliary frame 1 and is arranged to transfer the carriage arrangement 2 on the auxiliary frame 1 in the direction X that is common for the sheet metal working centre. The linear servo motor arrangement can advantageously comprise, instead of one linear servo motor, two or a plurality of linear servo motors that are placed in parallel next to each other in the longitudinal direction of the auxiliary frame 1.

In an alternative embodiment, the sheet metal working centre can comprise at least two carriage arrangements, instead of the one carriage arrangement 2 illustrated in the FIGURE, these carriage arrangements being applied to perform a machining order of their own, naturally at different positions of the common direction X at a different time.

The embodiment of the FIGURE comprises the following machining units 4 to 11: a perforating unit 4, a threading unit 5, a riveting unit 6, an adhesive unit 7, a marking unit 8, a deep drawing unit 9, a laser cutting unit 10, and an angle cutting unit 11, these being placed, in a manner characteristic to the invention, in the longitudinal direction of the auxiliary frame 1, sequentially at the auxiliary frame 1 in the lateral direction. Thus, this embodiment is widely applicable with respect to possibilies to perform various machinings and/or other measures directed to sheets. The length of the auxiliary frame 1, as well as the linear motor arrangement and the positioning means placed in connection therewith, can be selected to correspond to the length requirements of the application used at the time.

The use of the method of the invention can be exemplified as follows: Let us suppose that for a sheet mounted on the carriage arrangement 2 there is programmed, on the control unit of the sheet metalworking centre, a machining and/or treating requirement, e.g. perforation, riveting and angle cutting, characteristic to the sheet in question or common to a certain number of sheets. Thus, upon applying the method the carriage arrangement 2, together with the sheets 3 (fetched to the mounting means of the carriage arrangement 2 from a sheet storage (not shown) included in the sheet metal working centre), are transferred in parallel with the longitudinal direction of the auxiliary frame 1 (the common direction X) until the origin of the coordinates X, Y of the perforating unit 4 is recognised and the sheet 3 starts to perform the perforating machining portion implemented in the separate coordination X, Y of the perforating unit, in accordance with a program stored in the control unit. A corresponding transfer to the location of the riveting unit 6, i.e. the identification of the origin point, and the riveting machining portion performed thereafter, is carried out after the aforementioned perforation. After the riveting machining portion, the last phase carried out in the example is angle cutting, which is performed in accordance with the type of action described above, and the machined sheet exits the sheet metal working centre.

What is claimed is:

1. In a sheet metal working center having at least one moving carriage arrangement, a method of machining a sheet comprising the steps of:

transferring the sheet secured to a mounting member of the at least one moving carriage arrangement in accordance with a predetermined program for machining of the sheet, the sheet being transferred substantially in XY orthogonal coordinates along the main plane of the sheet;

machining the sheet by means of machining units, at least two of the machining units performing different machinings of the sheet, said at least two machining units being positioned in the sheet metal working center having separate XY orthogonal coordinates;

combining directions X of said separate XY orthogonal coordinates into a common direction X of said sheet metal working center;

transferring the at least one moving carriage arrangement and the sheet secured to the mounting member thereof in said common direction X in accordance with the predetermined program between machinings and/or during machinings performed by said at least two machining units; and providing a control algorithm in a control unit in connection with the sheet metal working center for identifying respective origin points of said separate XY orthogonal coordinates of said at least two machining units, said respective origin points being located in the common direction X.

2. The method as set forth in claim 1, further comprising: maintaining the position of the mounting member unchanged relative to the sheet when the at least one moving carriage arrangement and the sheet secured to the mounting member thereof are transferred between machinings performed by different machining units.

3. A sheet metal working center, comprising:

a moving carriage arrangement having a mounting member for transferring a sheet secured thereto in accordance with a predetermined program substantially in XY orthogonal coordinates along the main plane of the sheet in order to be machined by machining units positioned in the sheet metal working center;

at least two of said machining units for performing different machinings on the sheet having separate XY orthogonal coordinates, directions X of said separate XY orthogonal coordinates being combined to a common direction X of said sheet metal working center, said common direction X being longitudinally parallel with an auxiliary frame, the moving carriage arrangement and the sheet secured to the mounting member thereof being arranged to be transferred in said common direction X in accordance with the predetermined program between machinings and/or during machinings performed by said at least two machining units; and a control algorithm in a control center operatively connected to the sheet metal working center, said control algorithm being arranged to identify respective origin points of said separate XY orthogonal coordinates of said at least two machining units, said respective origin points being located in the common direction X.

4. The sheet metal working center as set forth in claim 3, wherein the common direction X is formed on said auxiliary frame that is separate from the respective frames of the machining units and to which the moving carriage arrangement, together with the mounting member thereof, are mounted to and move along, and wherein the machining units are positioned sequentially in the longitudinal direction of the elongated auxiliary frame.

5. The sheet metal working center as set forth in the claim 4, wherein the auxiliary frame comprises a linear servo motor arrangement that substantially shares the same length with the auxiliary frame, said linear servo motor arrangement comprising one or more linear servo motors and being arranged to transfer the moving carriage arrangement in the common direction X.

6. The sheet metal working center as set forth in the claim 4, wherein the sheet metal working center comprises at least two moving carriage arrangements.

7. The sheet metal working center as set forth in the claim 3, wherein the auxiliary frame comprises a linear servo motor arrangement that substantially shares the same length with the auxiliary frame, said linear servo motor arrangement comprising one or more linear servo motors and being arranged to transfer the moving carriage arrangement in the common direction X, and wherein the auxiliary frame and the moving carriage arrangement comprise a member for positioning the moving carriage arrangement in the common direction X.

8. The sheet metal working center as set forth in the claim 7, wherein the sheet metal working center comprises at least two moving carriage arrangements.

9. The sheet metal working center as set forth in the claim 3, wherein the sheet metal working center comprises at least two moving carriage arrangements.

10. In a sheet metal working center having at least one carriage arrangement movably mounted to a frame extending along a longitudinal direction, a plurality of machining units positioned proximate to said frame, each of said machining units having its own origin point for performing different machining operations, a method of machining a sheet in the sheet metal working center comprising the steps of:

securing the sheet to the at least one carriage arrangement;

transferring the sheet by the carriage arrangement in accordance with a predetermined program for machining the sheet substantially in XY orthogonal coordinates along the main plane of the sheet;

machining the sheet by at least two of the machining units, said at least two machining units performing different machining operations on the sheet, said at least two machining units having separate XY orthogonal coordinates;

combining directions X of said separate XY orthogonal coordinates into a common direction X of said sheet metal working center;

transferring the at least one moving carriage arrangement and the sheet secured thereto along said common direction X in accordance with the predetermined program between and/or during machining operations performed on the sheet by said at least two machining units; and providing a control algorithm in a control unit operatively connected to the sheet metal working center for identifying the respective origin points of said separate XY orthogonal coordinates of said at least two machining units, said respective origin points being located in the common direction X.

11. The method as set forth in the claim 10, further comprising the step of:

providing at least two moving carriage arrangements in the sheet metal working center.

12. The method of claim 11, further comprising the step of:

providing position detect means for positioning the carriage arangement along the common direction X.

* * * * *